US009706828B2

(12) United States Patent
Nakamoto

(10) Patent No.: US 9,706,828 B2
(45) Date of Patent: Jul. 18, 2017

(54) INFLATABLE WATER SELF-RESCUE AND CARRYING DEVICE

(71) Applicant: Ivan L. Nakamoto, Mississauga (CA)

(72) Inventor: Ivan L. Nakamoto, Mississauga (CA)

( * ) Notice: Subject to any disclaimer, the term of this patent is extended or adjusted under 35 U.S.C. 154(b) by 0 days.

(21) Appl. No.: 14/726,862

(22) Filed: Jun. 1, 2015

(65) Prior Publication Data

US 2015/0259055 A1 Sep. 17, 2015

Related U.S. Application Data

(63) Continuation-in-part of application No. 13/962,390, filed on Aug. 8, 2013, now abandoned.

(51) Int. Cl.

| | |
|---|---|
| ***B63C 9/00*** | (2006.01) |
| ***A45F 3/15*** | (2006.01) |
| ***B63C 9/15*** | (2006.01) |
| ***A63B 31/12*** | (2006.01) |
| ***B63B 35/71*** | (2006.01) |

(52) U.S. Cl.

CPC ..... *A45F 3/15* (2013.01); *A63B 31/12* (2013.01); *B63B 35/71* (2013.01); *B63C 9/155* (2013.01); *B63B 2035/715* (2013.01)

(58) Field of Classification Search

CPC .... B63C 9/00; B63C 9/08; B63C 9/13; B63C 9/18; B63C 9/155; B63C 2009/00

USPC ..... 441/60, 61, 80, 88, 90, 125, 129, 133, 441/136

See application file for complete search history.

(56) References Cited

U.S. PATENT DOCUMENTS

| | | | | | |
|---|---|---|---|---|---|
| 1,611,427 | A | * | 12/1926 | Evans | B63C 9/155 441/122 |
| 2,694,395 | A | * | 11/1954 | Brown | A61F 5/012 128/118.1 |
| 3,427,022 | A | * | 2/1969 | Ward | A63B 21/0606 446/153 |
| 3,734,367 | A | | 5/1973 | Jackson | |
| 3,986,723 | A | | 10/1976 | Brockelsby | |
| 4,300,759 | A | * | 11/1981 | Caplan | B63C 9/155 128/DIG. 20 |
| 4,649,846 | A | | 3/1987 | Javanelle | |
| 4,671,507 | A | * | 6/1987 | Huttner | A63B 21/06 441/122 |
| 4,804,025 | A | | 2/1989 | Bear | |
| 4,804,326 | A | | 2/1989 | Lennon | |
| 4,858,913 | A | | 8/1989 | Stuart | |

(Continued)

*Primary Examiner* — Daniel V Venne

(57) ABSTRACT

An inflatable device for water self-rescue comprising one or more buoyant inflatables having a substantial size and shape to secure to one or both lower extremities of a self-rescuer, or to one or both shoulders of a single human carrier for transport of watercraft for another embodiment. Shapes of the various inflatable embodiments include an incurvate side, triangular prism, streamlined, and to encompass a portion of the lower extremity. Embodiments include one or more straps to secure the inflatable to the lower extremity, another inflatable, or the watercraft. The device secured to the lower extremity increases water-area and buoyancy to more effectively engage the lower body muscles while performing a standard or similar self-rescue maneuver to aid reboarding watercraft or swimming to safety. The device makes possible single human transport of watercraft which lack a design structure for solo transport such as a kayak.

20 Claims, 4 Drawing Sheets

(56) References Cited

U.S. PATENT DOCUMENTS

| | | | | |
|---|---|---|---|---|
| 4,874,120 | A | 10/1989 | Paton | |
| 4,936,804 | A | 6/1990 | Dowdeswell | |
| 4,977,844 | A | 12/1990 | Barr | |
| 5,087,217 | A | 2/1992 | Tuan | |
| 5,242,321 | A | 9/1993 | Gil | |
| 5,261,680 | A | 11/1993 | Freitus | |
| 5,279,248 | A | 1/1994 | Blachford | |
| 5,542,369 | A | 8/1996 | Ingram | |
| 5,547,246 | A | 8/1996 | Lambert | |
| 5,643,155 | A * | 7/1997 | Kallassy | A63B 21/0084 482/111 |
| 5,791,279 | A | 8/1998 | Hart | |
| 5,875,946 | A | 3/1999 | Knudsen | |
| 6,019,263 | A | 2/2000 | Palmer | |
| 6,032,964 | A | 3/2000 | Capobianco | |
| 6,095,599 | A | 8/2000 | Lambert | |
| 6,129,600 | A | 10/2000 | Nordby | |
| 6,129,601 | A | 10/2000 | Aucoin | |
| 6,315,177 | B1 | 11/2001 | Weatherall | |
| 6,416,066 | B1 | 7/2002 | Ciulis | |
| 6,446,570 | B1 | 9/2002 | Johnson | |
| 6,681,968 | B2 | 1/2004 | Zwagerman | |
| 6,769,378 | B1 | 8/2004 | Dang | |
| 8,376,914 | B2 * | 2/2013 | Avrett | A63B 21/0606 441/129 |
| 8,979,605 | B2 * | 3/2015 | Senn | B63C 9/155 441/92 |
| 2009/0075537 | A1 | 3/2009 | Devers | |
| 2011/0259929 | A1 | 10/2011 | Edlebeck | |
| 2012/0090521 | A1 * | 4/2012 | Zablocki | B63B 43/10 114/121 |
| 2012/0216738 | A1 | 8/2012 | Altfather | |

* cited by examiner

INFLATABLE WATER SELF-RESCUE AND CARRYING DEVICE

CROSS-REFERENCE TO RELATED APPLICATIONS

This is a continuation-in-part of application Ser. No. 13/962,390, Filed Aug. 8, 2013, abandoned now after this application.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

The masses of men, women, and children participating in activities utilizing a watercraft such as a kayak, a canoe, an inflatable, a fishing, a hunting, and a sailing boat is likely at an historic high given the population growth, people living longer more active lives, increasing participation by people with disabilities, and newer types of watercrafts.

Paddlers are travelling farther afield, undertaking a greater number, more arduous and longer portages for the exhilaration of running white-water rapids, exploring and photographing unspoiled natural beauty, fishing for their favourite species, or savouring the spiritual tranquility. Consequently, taking paddlers farther away from sources of rescue, and placing a greater reliance on self-rescue.

Moreover, narrower and lighter watercrafts such as kayaks increase the risk of drowning not only due to the higher risk of initial capsize, but also the higher risk of secondary capsize, of overturning the watercraft onto the self-rescuer when attempting to re-enter, mount, reboard the watercraft from immersion in the water.

Self-rescue includes reboarding watercrafts such as kayaks and canoes after capsize; reboarding personal fishing, hunting, and sailing boats after falling overboard; and swimming to safety.

For many years the commonly accepted water safety wisdom was to always remain with the watercraft when one is immersed in water and not able to reboard the watercraft. However, a growing number of people have been questioning and disagree with that belief, primarily for aquatic conditions such as cold water and the risk of hypothermia, and other dangers in close proximity. The decision to stay with the watercraft or to swim to safety remains with each self-rescuer to be decided at the crucial self-rescue time, under known physical, mental, and environmental conditions. However, prior art does not exist which aids the self-rescuer regardless of the difficult decision made. Prior art exists to aid reboarding watercraft, or to aid swimming to safety.

Standard Self-Rescue without Aids.

A standard self-rescue maneuver for users of personal watercraft such as kayaks, canoes, inflatables, an outboard motor, and sailing boats is generally as follows: while immersed in water the self-rescuer positions him/herself at, facing, and holding onto the upright watercraft where it has greatest stability for reboarding such as at the midsection, with his/her body floating substantially stretched out horizontally on the surface of the water, face down, and perpendicular to the watercraft. Then, primarily using his/her upper body strength to lift his/her upper body up out of the water, while simultaneously kicking his/her legs, and to propel him/herself forward, while simultaneously pulling the watercraft toward him/her, onto the watercraft. Next, he/she carefully maneuvers his/her legs onto the watercraft. To perform this maneuver successfully such as to avoid overturning the watercraft onto the self-rescuer, he/she must have sufficient capability to perform this maneuver in a rapid, fluid motion.

Individuals unfamiliar with the standard self-rescue maneuver will instinctually perform similar maneuvers to reboard the watercraft which includes holding onto the watercraft with his/her hands and using his/her upper body strength to climb onto the watercraft while kicking his/her legs.

A method of self-rescue specific for kayakers utilizing kayaks with a cockpit and a spray skirt is to perform what has historically been referred to as an Eskimo roll. However, that requires significant skill, strength, and frequent practise which a great many kayakers lack. Additionally, an injury during a day or weeks for longer trips may prevent the successful performance of this already difficult maneuver.

Successfully performing the standard or a similar self-rescue maneuver is dependent on many factors such as the physical and mental condition of the self-rescuer at the crucial self-rescue time, and environmental conditions.

The physical condition of the self-rescuer before the outing or trip is one factor which contributes to the success or failure of self-rescue: size, shape, weight, upper and lower body strength, stamina, flexibility, coordination, skills, disability if any, and mental strength to remain calm, think clearly, and persevere while in danger.

During the trip, accidents and illnesses can occur to weaken the physical and mental condition of the self-rescuer, thus, weakening his/her ability to perform self-rescue. Whether the trip is for the day or weeks, accidents can occur, especially, with growing fatigue. A simple slip on a wet rock may cause injury to a hand, a wrist, an arm, a shoulder, a back, and other parts of a body of the self-rescuer which will subsequently be required to successfully perform self-rescue. Cold, wet, windy days may increase the likelihood of illness, and drain physical and mental energy which will later be required by the self-rescuer to successfully perform self-rescue. Mammals, reptiles, insects, jelly fish, spoiled food, and unsafe drinking water can also cause unexpected harm to the self-rescuer whether at a campsite, or on the water.

A plethora of uncontrollable, changing, often suddenly and unpredictably, environmental variables may impact the success of self-rescue such as wind speed, water current, wave height, water temperature, amount of sunlight, and precipitation. Each uncontrollable variable may impede the success of the self-rescue attempt, let alone acting in combination against self-rescue.

Self-rescuers need to be able to perform self-rescue under all severity of conditions which he/she may unexpectedly find him/herself immersed in such as cold turbulent water with waves crashing against and tossing him/her about, aquatic dangers in close proximity, numb and shaky hands, physically injured and sick, choking on water, attempting to control his/her fear, disoriented, and confused with the sun quickly setting. Unless planned, no one expects to capsize or fall overboard. However, failure to perform self-rescue, even once, in one situation, can be unforgiving.

Each prior art exists to be operated in essentially one mode by everyone, whether he/she is strong and healthy, or injured and sick, and under all severity of environmental conditions. That is, every self-rescuer, under all conditions, must adapt him/herself to the prior art, or possibly drown.

Furthermore, the one-mode-for-all prior art must be selected before the trip even begins. Thus, forcing the self-rescuer to accurately guess the physical, mental, and environmental conditions under which he/she will unexpectedly be required to perform self-rescue, in order to select the prior art suitable for him/her under those conditions, if any exists. What may be a calm, pleasant, sunny day can quickly and unexpectedly become a life threatening situation requiring self-rescue. An incorrect guess could prove fatal.

Each self-rescue prior art is one-mode-for-all: environmental conditions from calm, warm waters of the Florida Everglades to stormy, icy waters off the coast of Alaska; and, for everyone, for an enormous diversity of girls, boys, youth, college athletes, young couples, middle-age families, senior men and women, and people with a broad range of disabilities who also desire and deserve to enjoy the freedom of the open water.

Successfully reboarding watercrafts such as kayaks, canoes, inflatables, outboard motor, and sail boats requires having sufficient upper body strength. The amount of upper body strength required is dependent on a number of factors such as environmental conditions, watercraft stability, and freeboard height.

It is a common belief that females have less upper body strength than males and are more likely to require assistance to reboard the watercraft, although a great many males also require assistance. Additionally, injury, sickness, and consumption of alcohol and other substances can weaken the upper body strength, thus, while immersed in water and attempting to perform self-rescue, suddenly, realizing assistance is required.

Prior Art for Water Self-Rescue.

Water self-rescue prior art exists that requires attachment to the watercraft and/or a paddle to operate. Thus, if the watercraft or paddle is swept away by the wind or waves, or damaged, then, the prior art becomes ineffectual, leaving the self-rescuer in peril. The growing trend for watercrafts and paddles to be composed of lighter weight material such as Kevlar and carbon increases the risk of watercrafts and paddles being swept away or damaged.

U.S. Pat. No. 6,769,378 issued to Dang discloses a telescopic arm used in combination with a kayak bearing a collapsible container that when extended and filled with water offers a counter weight to a kayaker using a ladder platform on the opposite side of the kayak. Disadvantages of Dang's device includes that it requires use with the kayak, has only one mode of operation for everyone under all conditions, requires considerable time and dexterity to operate, and is heavier and bulkier, especially considering the limited storage space of kayaks.

U.S. Pat. No. 5,542,369 issued to Ingram discloses a very large inflatable bladder attached to the deck of a kayak with a stirrup attached to the bladder which when deployed aids the kayaker to climb back onto the kayak. Disadvantages of Ingram's device includes that it requires attachment to the kayak, has one mode of operation, requires considerable time and dexterity to operate, and is heavier and bulkier, especially considering the limited storage space of kayaks.

U.S. Pat. No. 4,977,844 issued to Barr discloses an outrigger float with a step to reboard the small watercraft. The float is shaped to conform to and is stored against the side of the watercraft when not in use. Disadvantages of Barr's device includes that it requires use with small watercraft, has only one mode of operation, and is heavier and bulkier which impacts operation of the watercraft.

U.S. Pat. No. 6,129,600 issued to Norby discloses an inflatable float with multiple fins attached to one kayak paddle blade to be used in an outrigger manner to assist reboarding the kayak. The paddle end with the float attached is placed on the water perpendicular to the kayak with the opposite end of the paddle on the kayak. Disadvantages of Norby's device includes the difficulty to use even in relatively calm waters, self-rescuers need to first learn and then continue to practice how to maneuver and balance various parts of their body to climb onto the kayak, and requires use with the paddle.

U.S. Pat. Applic. Pub. No. 20120216738 by Altfather for a Kayak Capsize Recovery System discloses an inflatable float attached to one end of a kayak paddle, a pouch connected to the kayak to receive the other end of the paddle, and a strap to connect the paddle float to the kayak. Disadvantages of Altfather's device includes that it is only applicable to and requires operation with kayaks having adequate bow and stern floatation, only has one mode of operation, and the difficulty to operate.

U.S. Pat. No. 5,279,248 issued to Blanchford discloses a large bladder having a handle and actuation by compressed air which the kayaker deploys while upside-down in the capsized kayak, to re-right the kayak. Generally, Blanchford's device replaces the function of the paddle for performing the Eskimo roll. Disadvantages of Blanchford's device includes considerable amount of upper body strength and skill is required, and difficulty operating while upside-down, likely disoriented, attempting not to panic, and thinking clearly, plus, operation is time limited to the duration he/she can hold his/her breath.

Prior Art to Increase Buoyancy.

Prior art to increase buoyancy of a user in whole or in part does not disclose water self-rescue as an intention. Inclusion herein is to demonstrate the extent of the woeful state of water self-rescue prior art.

A personal floatation device ("PFD") as named is a floatation device. They require little or no active participation. Some can be used while unconscious. Naturally floating is better than drowning, but dangers such as hypothermia, water bound living and non-living hazards, water current or tide sweeping away from safety such as land, succumbing to injuries, inability of others to provide sufficient aid, and so forth requires more than just floating.

As is commonly known in at least the kayaking community, PFDs may impede the standard or similar self-rescue maneuver. Females, especially with large chests made even larger by wearing a bulky PFD, have been known to have more difficulty raising their torso up to a sufficient height out of the water, and with sufficient power to propel themselves onto the watercraft.

The water-area and water-resistance created by the PFD also hinders forward movement by the self-rescuer such as when swimming to shore, although wearing the PFD cannot be overemphasized.

U.S. Pat. No. 4,936,804 issued to Dowdeswell discloses an annular, buoyancy aid which is ideal for use in calm waters of lakes or pools for the purpose of recreation or relaxation. Disadvantages of Dowdeswell's device for self-rescue, for which the device is not intended, includes that it can easily move about and slip off the user's legs especially in non-calm waters, the amount of buoyancy is constant, and only has one mode of operation for everyone under all conditions.

U.S. Pat. Applic. Pub. No. 20090075537 by Devers for a Whitewater ankle floatation safety device discloses a pair of buoyant assembly bands that wrap around the user's lower leg or is incorporated into an item of clothing worn by the user to increase the buoyancy of the feet to reduce the risk of foot entrapment such as by boulders in rapids. Disadvantages of Devers' device for self-rescue, for which the device is not intended, includes that the amount of buoyancy is constant, and the bands are intended to increase buoyancy for the user's feet, thus, to increase buoyancy such as for self-rescue would require very large and bulky bands. Moreover, since Dever's bands are worn while boating, the large and bulky bands would interfere with other movements such as escaping a capsized kayak, which could lead to drowning.

Swimming Aids and Aquatic Exercise Prior Art.

Swimming aids and aquatic exercise prior art do not disclose water self-rescue as an intention. Inclusion herein is to demonstrate the extent of the woeful state of water self-rescue prior art.

Swimming flippers such as U.S. Pat. No. 5,087,217 issued to Tuan; U.S. Pat. No. 5,242,321 issued to Gil; and U.S. Pat. No. 6,129,601 issued to Aucoin disclose a water resisting flange which is removably attached to the feet of the swimmer. Disadvantages of swimming flippers for reboarding watercraft, for which they are not intended, include the lack of buoyancy or buoyancy neutrality, only one mode of operation for everyone under all conditions, difficulty to position onto the feet while in rough water and holding onto the watercraft, and are bulkier in size for storage within watercrafts such as kayaks.

U.S. Pat. No. 4,804,326 issued to Lennon discloses a device for a very specific swimming instruction floatation problem. Lennon's device provides a subtle floatation force at the ankles to lift the swimmer's legs to a horizontal position. Lennon's device is a cylindrical sleeve of resilient cellular material. Disadvantages of Lennon's device for water self-rescue, for which the device was not intended, include: while the user is immersed in water, Lennon's device is difficult to pull over bare feet onto the ankles; the user is required to remove any footwear such as shoes; the amount of buoyancy is constant; the sleeve provides subtle floatation for the ankle, thus, to increase buoyancy such as for self-rescue would require larger and bulkier sleeves, and has only one mode of operation.

U.S. Pat. No. 4,858,913 issued to Stuart discloses an exercise device to provide resistance through water. Stuart's device includes an enclosure to which buoyant body members can be inserted, and a strap and buckle for attachment to the user. Disadvantages of Stuart's device for water self-rescue, for which the device was not intended, include the difficulty to operate while immersed in water, especially, in cold water with numb hands and holding onto the watercraft, to attach the strap and buckle, and adding or removing inserts, and Stuart's device only has one mode of operation.

U.S. Pat. No. 4,671,507 issued to Huttner discloses a pair of inflatable exercise devices each including an upper and lower chamber, and each chamber includes a separate inflating mechanism. Huttner's device is slipped over the foot, and secured to the leg by a securing mechanism such as a cord member and clamped by a clamping assembly. Huttner's device is intended to be used in safe exercise environments such as swimming pools. Disadvantages of Huttner's device for water self-rescue, for which the device was not intended, include the difficulty to operate while immersed in water, especially cold rough water while holding onto the watercraft, including the time, energy, and dexterity required to inflate four chambers, remove any footwear, slide the device over the foot and onto the leg, operate two securing mechanism, and operate two clamping assemblies.

Prior art exists which provides assistance to self-rescuers to reboard watercraft, increases buoyancy for users immersed in water, and aid swimming; however, prior art does not exist that fulfills all of those functions.

There remains a need for a water self-rescue device.

There remains a need for a water self-rescue device comprising: operable for the self-rescuer while participating in a variety of aquatic activities using watercrafts such as kayaks, canoes, inflatables, fishing, hunting, and sailing boats; multiple modes of operation which the self-rescuer selects under known environmental, and physical and mental conditions of the self-rescuer at the crucial self-rescue time; adjustable amount of assistance provided which is selected by the self-rescuer at the self-rescue time; faster and easier installation and operation; operation without requiring attachment to the watercraft; operation without requiring attachment to the paddle; smaller in size and lighter in weight; assists the self-rescuer who lacks the upper body strength to reboard the watercraft; and aids both reboarding the watercraft and swimming to safety.

Portaging Watercrafts Such as Kayaks.

The watercraft industry is growing and evolving, expanding their product line to include newer products such as a paddleboard, while expanding existing lines such as kayak types: a single and a tandem cockpit, an open cockpit, a sit-on-top, a white-water, a sea, and an inflatable. Indicative of the expansion of kayak types was a naming problem. Kayaks without cockpits were previously commonly referred to as open cockpit kayaks, but with the advent of kayaks with wide, open cockpits they are now referred to as sit-on-top kayaks. Thus, herein, open cockpit refers to kayaks with wide, open cockpits, and sit-on-top refers to kayaks without the cockpit.

Watercrafts such as kayaks that lack a design feature to allow for carriage by one human is problematic for all but very short distances. A method commonly used to carry the kayak is to position a portion of the inside cockpit rim on a shoulder of the carrier such that the kayak substantially hangs from the shoulder. However, this can cause injury to the shoulder, a side, and a back of the carrier, and other physical problems due to asymmetrical weight distribution. Asymmetrical weight distribution is also problematic when two carriers carry the kayak, commonly in an upright position and each carrier holds a bow or a stern handle with a hand, with the kayak positioned at the side of the carrier.

Prior art such as disclosed in the following uses a sling suspended from one shoulder with the ends of the sling encircling the watercraft, which results in asymmetrical weight distribution of the watercraft that can cause physical harm to the carrier: U.S. Pat. No. 4,804,025 issued to Bear for a Carrying harness for surfboards and the like; and U.S. Pat. Applic. Pub. No. 2011/0259929 to Edlebeck for a Clip on kayak carry strap.

Prior art exists which distributes the kayak weight across both shoulders of the carrier by using a rigid detachable yoke which is fastened to the cockpit rim by a solid clamp such as the Universal Kayak Yoke by Hidden River Yoke Shop shown in website http://www.boundarywaterscatalog.com/hidden-river-yoke-shop/universal-kayak-yoke-6722. These rigid yokes can only be used for kayaks having cockpits. Moreover, the rigid yoke fastening mechanism can damage the cockpit rim over time by the stress induced from the twisting and bouncing movement of the kayak while being carried, especially over uneven terrain. Kayaks composed of lighter weight material such as carbon-Kevlar and fiberglass are generally more expensive than polyethylene and are more susceptible to damage, thus, greater economic damage could result from using rigid yokes. The integrity of the cockpit rim is important since the spray skirt must encircle it snugly to seal out water which is especially important in frigid and turbulent water, thus, greater risk to the physical wellbeing of the carrier could result from using rigid yokes.

Furthermore, rigid yokes that have a protruding stem, of which there are two, positioned one on each shoulder of the carrier such as the Universal Kayak Yoke are difficult for the single carrier to lift the kayak off the ground, invert it, and position the stems exactly on his/her shoulders. Failure to position the protruding stems exactly may cause pain or injury to a head and shoulders of the carrier, even before the start of the potentially long and arduous portage. Plus, the rigid yoke weight is an additional burden for portaging, and the bulky shape and size consumes more valuable storage space. Rigid yokes without protruding stems are more problematic for providing sufficient forward visibility for the carrier to avoid obstacles such as overhanging tree branches, especially, while carrying kayaks with a higher deck.

There exists in prior art a kayak portage harness for carrying the kayak in a substantially vertical position with the hull of the kayak against the back of the carrier as disclosed in U.S. Pat. No. 6,681,968 issued to Zwagerman; and the BAK YAK Harness by Salamander Paddle Gear shown in website http://salamanderpaddlegear.com/product/bak-yak-harness. The portage harness is severely limited in use to shorter kayaks, for portages with fewer vertical impediments such as tree branches, and during times with less wind resistance. Another disadvantage is that a backpack used to transport food, clothing, and other equipment cannot be used simultaneously with the kayak portage harness.

U.S. Pat. No. 3,734,367 issued to Jackson; U.S. Pat. No. 5,547,246 issued to Lambert; U.S. Pat. No. 5,875,946 issued to Knudsen; U.S. Pat. No. 6,019,263 issued to Palmer; U.S. Pat. No. 6,095,599 issued to Lambert; and U.S. Pat. No. 6,315,177 issued to Weatherall utilize a back frame upon which the watercraft is transported which also precludes the simultaneous use of the carrier's own backpack which was likely selected to be more ergonomically suitable to his/her own physique, be more comfortable, and lessen the chance of injury. Using the back frame carrying device and the carrier's own backpack would require extra storage space, and cause the carrier to make an extra round-trip across each portage. Thus, a one kilometer portage becomes at least a three kilometer hike.

U.S. Pat. No. 4,874,120, issued to Paton, et al. is a rigid frame supported on the shoulders of the carrier for transporting cargo which requires greater dedication of considerable valuable storage space within or on the watercraft, and the frame weight is an additional burden to transport.

U.S. Pat. No. 4,649,846, issued to Javanelle uses a rigid frame positioned on the shoulders of the carrier and extends above the head, onto which a windsurfing board is placed. Straps attached to the frame are used by the head of the carrier to maneuver the device which can cause stress and/or injury to the head and a neck.

Prior art such as disclosed in the following utilize a type of dolly to transport canoes and kayaks across portages which requires dedication of substantially more storage space in the watercraft, and can be much more difficult to use over terrain which is rocky, sandy, muddy, steep, impeded by fallen trees and boulders, and lack a well-worn and sufficiently wide trail: U.S. Pat. No. 6,446,570 issued to Johnson; U.S. Pat. No. 6,416,066 issued to Ciulis; U.S. Pat. No. 6,032,964 issued to Capobianco; U.S. Pat. No. 5,261,680 issued to Freitus, et al.; U.S. Pat. No. 3,986,723 issued to Brockelsby; and U.S. Pat. No. 5,791,279 issued to Hart.

A need remains for an apparatus for single human transport of watercrafts such as kayaks.

There remains a need for an apparatus for carrying watercrafts such as kayaks by the single human that is operable for the wide variety of watercraft types, portaging terrains, and environmental conditions; smaller in size to reduce the storage space required within or on the watercraft; lighter in weight to carry; reduces the risk of damaging the watercraft; reduces the physical harm to the carrier when carrying the watercraft; aids the carrier to avoid obstacles; and allows for the simultaneous use of the carrier's backpack.

BRIEF DESCRIPTION OF THE SEVERAL VIEWS OF THE DRAWINGS

In the drawings, closely related figures have the same number but different alphabetic suffixes.

FIG. 12A depicts a carriage strap having two opposite ends releasably fastened by a buckle.

DETAILED DESCRIPTION OF THE INVENTION

Figure 1:
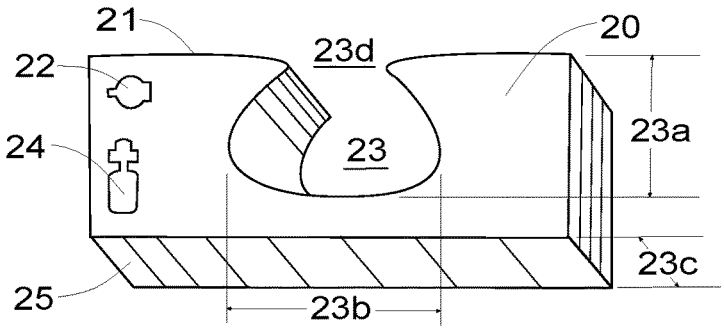
FIG. 1 is a front perspective view of one embodiment depicting an inflatable having an incurvate shape open side which is sufficiently curved to secure to a lower extremity of a self-rescuer, or a shoulder of a carrier.

Reference is made herein to the attached drawings. Reference herein to an inflatable is in an inflated mode unless otherwise stated. Reference herein to a lower extremity of a self-rescuer includes a foot, an ankle, a lower leg, a knee, and an upper leg. The lower extremity is shown with phantom dash and dot lines in the drawings. Reference herein to a standard self-rescue maneuver is as described in Background of the Invention section contained within this Specification. For the purpose of presenting a brief and clear discussion of a carrying embodiment, of which there are a plurality, discussion primary as depicted for use of carrying a watercraft such as a kayak is provided herein. The kayak is shown with phantom lines in the drawings. An inflatable water self-rescue and carrying device is also herein referred to in the shortened version of the title as a water self-rescuer, though no preferred embodiment is intended.

FIG. 1

Figure 2A:
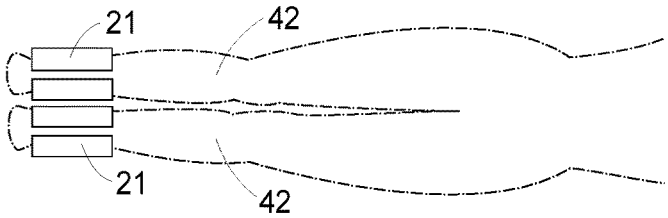
FIGS. 2A and 2B is a top view and bottom view respectively of one inflatable secured to each lower extremity of the self-rescuer when he/she is positioned to perform a standard self-rescue maneuver.
Figure 2B:
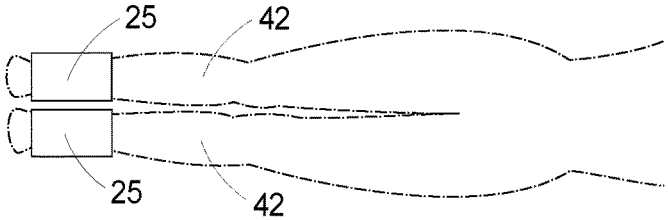

FIG. 1 is a front perspective view of one embodiment of the water self-rescuer comprising and depicting: a one or more than one inflatable 20; the one or more than one inflatable 20 having a shape; the shape having an open side 21 having an opening 23 and an opposite closed side 25; the opening 23 having a depth 23*a*, a width 23*b*, and a length 23*c* sized to a human having a one or two lower extremities 42 (depicted at least in FIGS. 2A and 2*b*); the depth 23*a* of at least a part of the opening 23, as considered from a top 23*d* of the opening 23 orthogonally straight down toward the opposite closed side 25, is about a depth of the one or two lower extremities 42, as considered from an anterior to posterior of the one or two lower extremities 42 at a greatest distance (depicted at least in FIG. 7); the width 23*b* of at least a part of the opening 23, as considered traversing the opening 23, is about a width of the one or two lower extremities 42, as considered transversely from side to side of the one or two lower extremities 42 at a greatest distance (depicted at least in FIGS. 2A and 2B), and above the width 23*b* of at least a part of the opening 23 is about the width of the one or two lower extremities 42 the width 23*b* is of lesser distance than the width of the one or two lower extremities 42 (depicted at least in FIG. 2A); the length 23*c* of the opening 23, as considered longitudinally, having a distance of a part of a length of the one or two lower extremities 42, as considered longitudinally along the one or two lower extremities 42 (depicted at least in FIGS. 2A and 2B).

FIG. 1 depicts inflatable 20 open side 21 having an incurvate shape opening 23 which is sufficiently curved to secure to, when the incurvate surface is in contact with, one or two lower extremities of the self-rescuer for water self-rescue. I presently contemplate that the incurvate curvature is 240 to 300 degrees, however, this is not intended to limit the use of other curvatures. Furthermore, this is not intended to limit the shape of inflatable 20 for use of other shapes including substantially cuboid, rhomboid, cylindrical, triangular prism, and streamlined.

Inflatable 20 has a substantial size to secure to one or two lower extremities of the self-rescuer without preventing the performance of the standard or a similar self-rescue maneuver.

The size of inflatables 20 and 20*a-d* depicted in the attached drawings is for representative purposes and is not intended to limit the use of other sizes.

Another embodiment comprises inflatable 20 having a substantial size to secure to a shoulder or both of the carrier without preventing the carrier from maneuvering the kayak with at least a hand while carrying the kayak.

Inflatable 20 is buoyant and constructed of a non-rigid material such as polyvinyl chloride with sufficient tensile and shear strength to resist punctures and support at least in part the self-rescuer when immersed in water for one embodiment, and support at least in part the kayak for another embodiment. The water self-rescuer includes one or more inflatables 20.

Inflatable 20 is inflated and deflated by a conventional mechanism, for example, an oral inflation valve 22, and a canister containing compressed air 24 which can be activated manually or automatically when exposed to water.

FIGS. 2A and 2B

FIGS. 2A and 2B is a top view and bottom view respectively of one inflatable 20 secured to each lower extremity 42 of the self-rescuer when he/she is positioned to perform the standard self-rescue maneuver: substantially horizontal at the surface of the water and facing downward, whereby the posterior of the lower extremities are at the surface of the water as explained in Background of the Invention. The opening 23 created by the incurvate shape of open side 21 of inflatable 20, shown in FIG. 1, is depicted as at the posterior of lower extremity 42 in FIG. 2A. The closed side 25 of inflatable 20 opposite to the incurvate open side 21, shown in FIG. 1, is depicted as at the anterior of lower extremity 42 in FIG. 2B, beneath the self-rescuer when positioned to perform the standard self-rescue maneuver.

FIGS. 2A and 2B depict the width 23*b* of at least a part of the opening 23, as considered traversing the opening 23, shown in FIG. 1, is about the width of the one or two lower extremities 42, as considered transversely from side to side of the one or two lower extremities 42 at the greatest distance. FIGS. 2A and 2B also depict the length 23*c* of the opening 23, as considered longitudinally, shown in FIG. 1, having a distance of a part of the length of the one or two lower extremities 42, as considered longitudinally along the one or two lower extremities 42.

Figure 7:
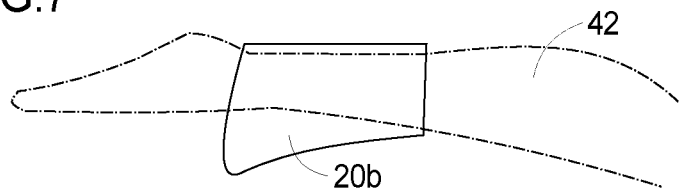
FIG. 7 is a side view depicting an inflatable having a substantially streamlined shape as secured to the lower extremity, illustrating another embodiment.

FIG. 2A is a top view of inflatable 20 depicting the top 23*d* of the opening 23 of open side 21, shown in FIG. 1. FIG. 7 depicts the depth 23*a* of at least a part of the opening 23, shown in FIG. 1, is about the depth of the one or two lower extremities 42. FIG. 2A also depicts above the width 23*b* of at least a part of the opening 23, shown in FIG. 1, is about the width of the one or two lower extremities 42, such as at the top 23*d* of the opening 23, the width 23*b* is of lesser distance than the width of the one or two lower extremities 42.

I contemplate that when the self-rescuer is immersed in water such as after capsizing his/her kayak, or a canoe, or falling out of a fishing, a hunting, a sailing, or an inflatable watercraft, he/she inflates inflatable 20 and positions the incurvate side against the anterior of his/her lower extremity 42, then, presses inflatable 20 against his/her lower extremity 42 to secure inflatable 20 onto his/her lower extremity 42, whereby the incurvate surface of inflatable 20 is in contact with and substantially conforms to the shape of lower extremity 42. Securing inflatable 20 to lower extremity 42 includes securing over items worn by the self-rescuer such as a pant, a shoe, and a sock.

An advantage of one or more aspects of the water self-rescuer compared to prior art includes faster and easier installation even in extreme conditions. Pressing inflatable 20 onto lower extremity 42 is faster, easier, and requires use of a hand (not depicted), which frees the other hand to hold onto the watercraft (not depicted) to ensure the watercraft is not swept away by the wind or waves (not depicted).

Self-rescuer then assumes the position to, and performs, the standard or similar self-rescue maneuver.

Another advantage of one or more aspects of the water self-rescuer is that the self-rescuer is not required to learn, practice, and remember new and/or difficult maneuvers since operation includes performing the already known standard or similar self-rescue maneuver.

Furthermore, even for the self-rescuer who does not know the standard self-rescue maneuver, or is confused, or panicky when in danger at a crucial self-rescue time, the water self-rescuer aids instinctual movements of the self-rescuer which is generally to hold onto the watercraft with his/her hands and kick his/her lower extremities 42 to attempt to basically climb onto the watercraft.

When inflatable 20 is secured to lower extremity 42, water-area and buoyancy of lower extremity 42 is effectively increased, thus, the self-rescuer is able to provide greater lift out of the water, and faster and farther propulsion by more effectively engaging his/her lower extremities when performing the standard or similar self-rescue maneuver to propel the self-rescuer onto the watercraft or to swim to safety such as to land.

I contemplate that the self-rescuer performs the standard self-rescue maneuver explained in Background of the Invention, and executes a dolphin kick, commonly known and used for a butterfly swimming stroke, instead of kicking his/her lower extremities 42 in any other manner. However, this should not be construed as limiting the device for use of other lower extremity movements such as used for a free-style and a breaststroke swimming stroke. Increased water-area and buoyancy provided by inflatable 20 coupled with the dolphin kick provides the benefit of enabling the self-rescuer to more effectively engage the strong muscles of his/her lower extremities, abdomen, and back to provide greater lift and propel the self-rescuer onto the watercraft.

An advantage of one or more aspects of the water self-rescuer is enabling self-rescuers with insufficient upper body strength to more effectively utilize his/her lower body strength to increase the overall effectiveness of his/her total body movement to successfully perform the standard or similar self-rescue maneuver.

Self-rescuers may have insufficient upper body strength to successfully perform the self-rescue maneuver even before the trip begins which is commonly known to be more likely for females than males, or during the trip his/her upper body strength may be weakened such as due to injury and illness, or weakened temporarily at the crucial self-rescue time such as due to fatigue and alcohol consumption. Thus, whether the insufficient upper body strength is known in advance of the aquatic activity, or suddenly realized during the attempted self-rescue, the water self-rescuer provides assistance which can provide the difference between success or drowning.

An advantage of one or more aspects of the water self-rescuer is that the amount of water-area and buoyancy assistance provided to the self-rescuer is adjustable by the amount of inflation and number of inflatables 20 which is selected by the self-rescuer under known conditions.

An advantage of one or more aspects of the water self-rescuer is operability by the self-rescuer while participating in a variety of aquatic activities utilizing a variety of watercrafts such as kayaks, canoes, inflatables, fishing, hunting, and sailing boats.

An advantage of one or more aspects of the water self-rescuer is that operation does not require use of the kayak or a paddle. If the kayak, paddle, or both are swept away by the wind or waves, the water self-rescuer is operable, unlike prior art.

The self-rescuer who decides to swim to safety inflates inflatable 20 to provide sufficient buoyancy for his/her lower extremities to be congruent with the buoyancy of his/her upper body, taking into consideration factors at the self-rescue time such as whether he/she is wearing a personal floatation device, pushing the watercraft to shore, and environmental conditions. Advantages of one or more aspects of the water self-rescuer is that the amount of buoyancy is adjustable, and as often as is necessary.

An advantage of one or more aspects of the water self-rescuer is the smaller size when not inflated, and lighter weight, thus, permitting removable attachment to the self-rescuer or to an item worn by the self-rescuer such as a belt while not hindering movement such as for paddling, fishing, hunting, and sailing. Therefore, the water self-rescuer is at-hand for use by the self-rescuer even after capsizing or falling overboard. However, this is not intended to limit the storage of the device at other locations such as removable attachment to part of the watercraft which is easily accessible by the self-rescuer from the water.

FIG. 3

Figure 3:
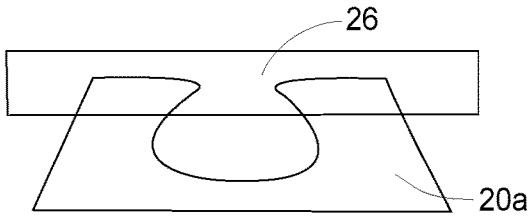
FIG. 3 is a front view of an inflatable having a shape in which the incurvate open side is narrower than the opposite closed side, and depicting a first means for releasably fastening the inflatable to the lower extremity which in combination with the inflatable surrounds the lower extremity to secure the inflatable to the lower extremity, illustrating another embodiment.

FIG. 3 is another embodiment depicting the front view of inflatable 20*a* having a shape in which the incurvate side is narrower than the opposite non-incurvate side, whereby the water-area beneath the self-rescuer is increased.

Additionally depicted in FIG. 3 is a first means for releasably fastening 26 inflatable 20*a* to the lower extremity of the self-rescuer which in combination with inflatable 20*a* surrounds the lower extremity to secure inflatable 20*a* to the lower extremity. However, this is not intended to limit use of first means 26 for other embodiments such as with inflatable 20 depicted in FIG. 1.

FIG. 4

Figure 4:
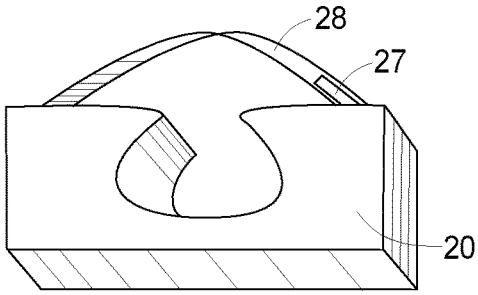
FIG. 4 is a perspective front view depicting a strap for releasably fastening the inflatable to the lower extremity which in combination with the inflatable surrounds the lower extremity to secure the inflatable to the lower extremity.

FIG. 4 is a perspective front view of another embodiment depicting a strap 28, of which there are one or more, for releasably fastening inflatable 20 to the lower extremity (not shown) which in combination with inflatable 20 surrounds the lower extremity to secure inflatable 20 to the lower extremity.

Strap 28 is comprised of non-rigid, water-resistant material generally used for outdoor applications in or around water such as nylon webbing; having an end, of which there are two opposite; a substantial length to at least extend transversely across one lower extremity of the self-rescuer; and a substantial width and a substantial strength to support at least in part the self-rescuer when immersed in water.

I contemplate one embodiment in which both ends of strap 28 are fastened to inflatable 20 and at least one end is releasably fastened such as by a conventional hook and loop fastening system 27.

Inflatable 20 is secured to the lower extremity with the incurvate surface of inflatable 20 in contact with the anterior and sides of the lower extremity, and strap 28 is positioned around the posterior of the lower extremity and releasably fastened to inflatable 20, whereby in combination strap 28 and inflatable 20 surrounds the lower extremity of the self-rescuer.

Thus strap 28, inflatable 20, and the hook and loop fastening system 27 constitute the first means for releasably fastening 26, however, it is not intended to limit the use of equivalents thereof.

I contemplate another embodiment in which strap 28 is comprised of an elastic, water-resistant material, and having two ends which are permanently or semi-permanently fastened to inflatable 20. Self-rescuer slides his/her lower extremity through an opening created between strap 28 and inflatable 20, and selectively positions inflatable 20 onto the lower extremity. The elastic material of strap 28 stretches to permit passage of the lower extremity with any item worn by the self-rescuer such as footwear, and then contracts to secure inflatable 20 to the selected position of the lower extremity.

An additional embodiment I contemplate includes strap 28 comprised of elastic, water-resistant material, with both ends fastened to inflatable 20, and at least one end is releasably fastened such as by the conventional hook and loop fastening system.

Examples of embodiments I contemplate as described herein are not intended to limit the use nor adaptation of the water self-rescuer for other embodiments.

FIG. 5

Figure 5:
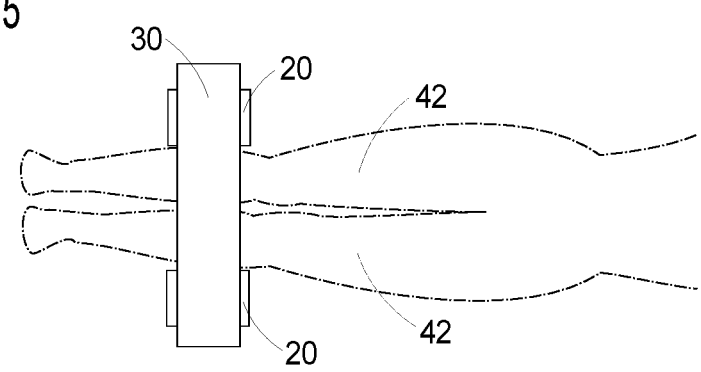
FIG. 5 is a bottom view depicting a second means for releasable fastening two or more inflatables to one or two lower extremities which in combination with two or more inflatables surrounds one or two lower extremities to secure the inflatables to the lower extremities, illustrating another embodiment.

FIG. 5 is a bottom view of the water self-rescuer depicting a second means for releasable fastening 30 two or more inflatables 20 to one or two lower extremities 42 of the self-rescuer which in combination with two or more inflatables 20 surrounds one or two lower extremities 42 to secure inflatables 20 to lower extremities 42, illustrating another embodiment.

FIG. 6

Figure 6:
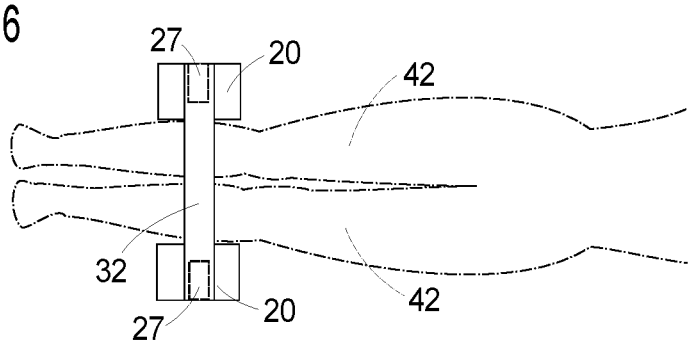
FIG. 6 is a bottom view depicting an extremity strap releasably fastened to two inflatables.

FIG. 6 is a bottom view of another embodiment depicting an extremity strap 32, of which there are one or more, comprised of non-rigid, water-resistant material generally used for outdoor applications in or around water such as nylon webbing, having a substantial length to extend at least transversely across one lower extremity 42, a substantial width and a substantial strength to support at least in part the self-rescuer when immersed in water. Extremity strap 32 is releasably fastened such as by the hook and loop fastening system 27 to two or more inflatables 20.

Extremity strap 32 releasably fastens two or more inflatables 20 to one or two lower extremities 42 which in combination with inflatables 20 surrounds one or two lower extremities 42 to secure inflatables 20 to lower extremities 42.

Thus extremity strap 32, inflatable 20, and the hook and loop fastening system 27 constitute the second means for releasably fastening 30, however, it is not intended to limit the use of equivalents thereof.

Another embodiment is extremity strap 32 with inflatables 20 releasably fastened positioned beneath one or two lower extremities. These examples are not intended to limit extremity strap 32 positioning, adaptation, nor use.

Extremity strap 32 with releasably fastened number of inflatables 20 selected by the self-rescuer increases water-area and buoyancy at and around the area of the self-rescuer's body in which the self-rescuer has selected at the self-rescue time, under known conditions: physical, mental, and environmental.

I contemplate, for example, the self-rescuer with an injury to one lower extremity positions extremity strap 32 to avoid contact with the injured area, and the non-injured lower extremity aided by the increased water-area and buoyance provided by the water self-rescuer is used to compensate for the injured lower extremity while performing the standard or similar self-rescue maneuver.

Another example includes an injury to the hand, a wrist, an arm, and/or a shoulder of the self-rescuer which renders him/her incapable of successfully performing the standard or similar self-rescue maneuver selects extremity strap 32 with three inflatables 20 releasably fastened to use as a boosting or support structure for him/her to step on to reboard the watercraft. Not shown.

Another example includes self-rescuers with a physical disability to one or two lower extremities selects the positioning of extremity strap 32, and selects the number of inflatables 20 to provide sufficient water-area and buoyancy to suit his/her requirements, depending on his/her disability.

FIG. 7

FIG. 7 is a side view of the water self-rescuer depicting inflatable 20*b* having a substantially streamlined shape as secured to lower extremity 42 of the self-rescuer, which is another embodiment I contemplate. However, it is not intended to limit inflatable 20*b* for other substantially streamlined shapes, sizes, and positions to which inflatable 20*b* is secured to lower extremity 42.

FIG. 7 depicts the depth 23*a* of at least a part of the opening 23, as considered from the top 23*d* of the opening 23 orthogonally straight down toward the opposite closed side 25, shown in FIG. 1, is about the depth of the one or two lower extremities 42, as considered from the anterior to posterior of the one or two lower extremities 42 at the greatest distance.

The streamlined shape reduces water resistance when the self-rescuer propels him/herself forward using the standard or similar self-rescue maneuver, thus, allowing for increased speed of the maneuver and success of the self-rescuer to reboard the watercraft; and, reducing the amount of energy required when the self-rescuer selects to swim to safety, thus, allowing the self-rescuer to swim farther.

I contemplate another embodiment of the water self-rescuer comprising streamline shaped inflatable 20*b* and first means for releasable fastening 26 (not shown). An additional embodiment I contemplate comprises streamline shaped inflatable 20*b* and strap 28 (not shown).

These embodiment examples are not intended to limit the use of the water self-rescuer for other embodiments.

FIG. 8

Figure 8:
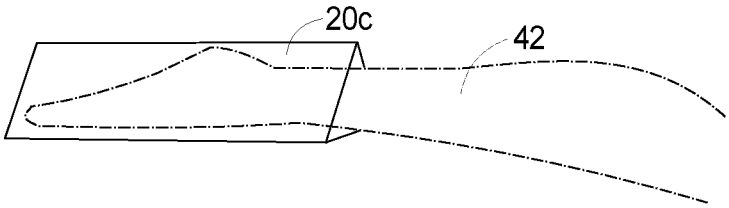
FIG. 8 is a side view depicting an inflatable having a substantial shape and size to encompass a segment of the lower extremity, illustrating another embodiment.

FIG. 8 is a side view of another embodiment depicting inflatable 20*c* having a substantial shape and size to encompass a segment of lower extremity 42. FIG. 8 depicts inflatable 20*c* having a substantially triangular prism shape, however, it is not intended to limit the shape and size of inflatable 20*c*, the number of lower extremities encompassed, nor segment of the lower extremity encompassed including with or without any items worn such as shoes.

I contemplate another embodiment, for example, in which inflatable 20*c* is substantially streamlined in shape as attached to lower extremity 42.

FIG. 9

Figure 9:
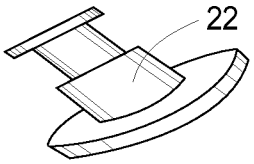
FIG. 9 is a side perspective view of an oral inflation valve shown in FIG. 1.

FIG. 9 is a side perspective view of oral inflation valve 22 shown in FIG. 1.

An advantage of one or more aspects of the water self-rescuer is that the mode of operation is selectable by the self-rescuer at the crucial self-rescue time, under known conditions: physical, mental, and environmental. The water self-rescuer is adaptable to the self-rescuer and self-rescue conditions; unlike prior art which requires the self-rescuer to adapt to it, under all conditions, or suffer the consequences, which could be death by drowning.

The multitude of variables, of which many are uncontrollable and include varying levels of intensity and may change suddenly, which can affect the success or failure of the attempted self-rescue include: water current strength and direction, wave height, water temperature, wind speed and direction, amount of sunlight, dangerous living creatures, proximity to non-living hazards, injury during capsize or previously on land, illness, and fatigue as explained in Background of the Invention.

Due to the enormous number of combinations of environmental variables and intensity of each, coupled with the plethora of self-rescuer physical shapes, sizes, strengths, skills, experiences, injuries, illnesses, disabilities if any, and further coupled with mental acuity and determination of the self-rescuer under dangerous conditions and/or impairment due to injury, it is not feasible to provide a comprehensive list of which mode of operating the water self-rescuer is best for each self-rescuer under every possible condition. Under safe conditions, it is recommended that the self-rescuer tries the various modes with and without various simulated injuries.

Another advantage of the water self-rescuer is the availability of back-up modes. If the self-rescuer selects a mode of operation but is not successful, he/she can attempt another mode, and another. That is, selection of one mode does not eliminate the use of others.

Advantages of one or more aspects of the water self-rescuer include: faster and easier installation and operation; assistance is provided to the self-rescuer who at the self-rescue time lacks the upper body strength to reboard the watercraft; adjustable amount of assistance is provided which is selectable by the self-rescuer at the self-rescue time; operable for use while participating in a variety of activities utilizing kayaks, canoes, inflatables, fishing, hunting, and sail boats; operation without requiring attachment to the watercraft; operation without attachment to the paddle; at-hand for use when the self-rescuer is immersed in water after capsizing or falling overboard as the smaller size and lighter weight permits removable attachment to the self-rescuer or an article worn by the self-rescuer without impeding movement of the self-rescuer such as for paddling, fishing, hunting, and sailing; multiple modes of operation which is selectable under known physical and mental conditions of the self-rescuer, and environmental conditions at the crucial self-rescue time; and provides assistance for reboarding the watercraft and swimming to safety.

Single Human Transport of Watercrafts Such as Kayaks.

FIG. 10

Figure 10:
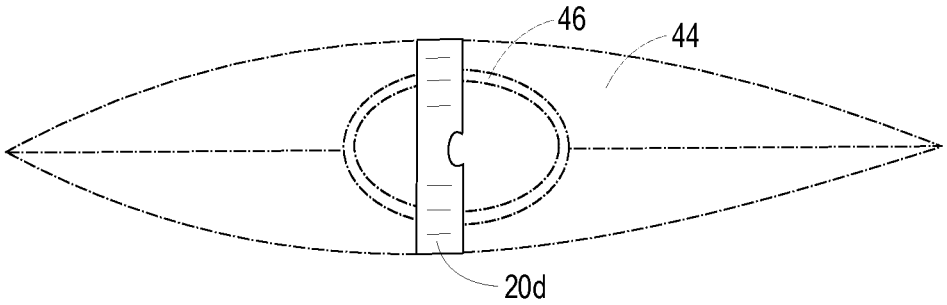
FIG. 10 is a top view depicting the size and shape of one inflatable for carrying a single cockpit kayak, illustrating one embodiment.

FIG. 10 is a top view of the water self-rescuer for the single human carrying watercraft such as kayak 44 having single cockpit 46, and depicting the size of inflatable 20*d* extending at least transversely across cockpit 46, and one side of inflatable 20*d* incurvate shaped at about the area of and to secure to a neck of the carrier (not shown), illustrating another embodiment.

I presently contemplate that the height of inflatable 20*d* when inflated is seven to twelve centimeters above the shoulders of the carrier, however, this is not intended to limit the use of other heights.

Reference herein to a carrying position for transport of watercraft such as the kayak includes the kayak in an inverted, substantially horizontal position on both shoulders of the carrier. Inverted refers to the kayak having a deck and a hull which are proximal and distal respectively to the shoulders of the carrier. I contemplate that the kayak is carried in an inverted position; however, it should not be construed as limiting the adaptation and use of the water self-rescuer.

Operation of the water self-rescuer as depicted in FIG. 10 includes inflating inflatable 20*d*, and positioning and securing inflatable 20*d* across the shoulders and about the neck of the carrier, then, positioning inverted kayak 44 on inflatable 20*d*. An inflatable kayak (not shown) is another example of watercraft transported with this embodiment, however, it is not intended to limit the carriage of other watercrafts such as sit-on-top kayaks.

Figure 11A:
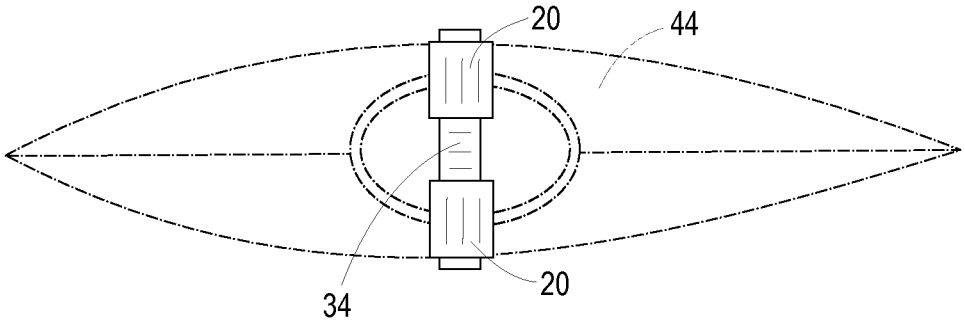
FIGS. 11A and 11B is a top and side view respectively for carrying the kayak depicting two inflatables, and a third means for releasably fastening the inflatables to the kayak which in combination with the inflatables releasably fastened to the third means secures the inflatables to the kayak, illustrating another embodiment.
Figure 11B:
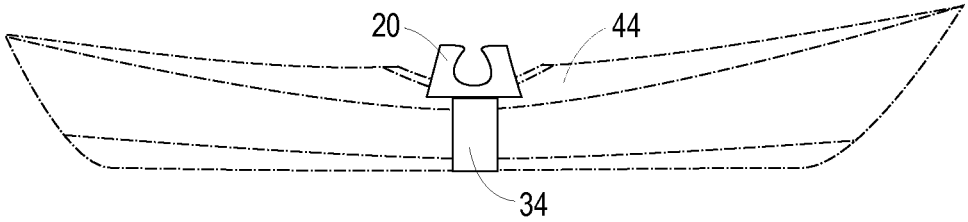

FIGS. 11A and 11B

FIG. 11A is a top view of another embodiment depicted for carrying kayak 44 comprising two inflatables 20, and a third means for releasably fastening 34 inflatables 20 to kayak 44 which in combination with inflatables 20 releasably fastened to third means 34 secures inflatables 20 to kayak 44. Third means for releasably fastening 34 having a substantial strength to support kayak 44.

Inflatables 20 are releasably fastened to third means 34 by conventional devices and systems, for example, the hook and loop fastening system 27. FIG. 11B is a side view of FIG. 11A.

Figure 12A:
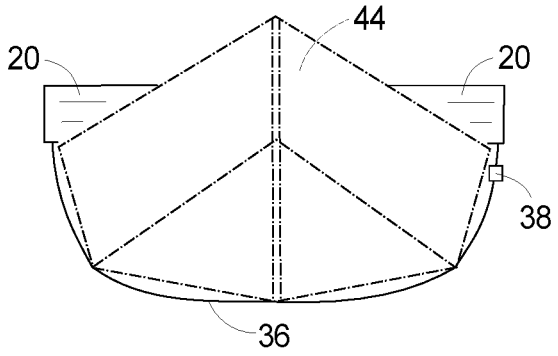
FIGS. 12A and 12B is a front and top view respectively of another embodiment depicted for carrying the kayak.
Figure 12B:
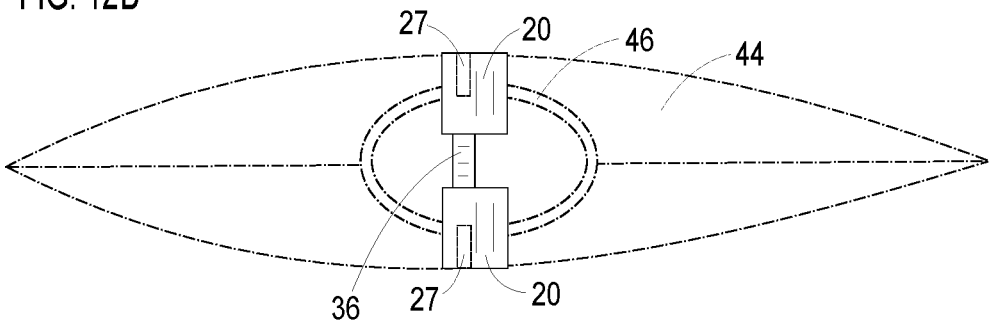

FIGS. 12A and 12B

FIGS. 12A and 12B is a front and top view respectively of another embodiment of the water self-rescuer for carrying kayak 44, depicting a carriage strap 36 having an end, of which there are two opposite, with one end releasably fastened to the other such as by a buckle 38 as depicted in FIG. 12A. Carriage strap 36 transversely, securely, encircles the external surface of kayak 44 at about the center of gravity of kayak 44, and has a substantial strength to support kayak 44. As depicted in FIG. 12B, inflatables 20 are positioned on the deck of kayak 44, one on each side of cockpit 46, and releasably fastened to carriage strap 36.

Carriage strap 36 is comprised of non-rigid, water-resistant material generally used for outdoor applications in or around water such as nylon webbing. Buckle 38 includes, for example, a center release buckle 40 depicted in FIG. 13, however, it is not intended to limit the use of other buckles, nor to limit the use to just buckles for releasably fastening the two ends of carriage strap 36.

Inflatables 20 are releasably fastened to carriage strap 36 by conventional devices and systems such as the hook and loop fastening system 27, but it is not intended to limit the use of other devices or systems.

Thus carriage strap 36, buckle 38, inflatable 20, and the hook and loop fastening system 27 constitute the third means for releasably fastening 34, however, it is not intended to limit the use of equivalents thereof.

After the water self-rescuer is secured to kayak 44, kayak 44 is lifted, inverted, and positioned onto the shoulders of the carrier such that inflatable 20 is positioned one on each shoulder with kayak 44 positioned on inflatables 20, and the hull of kayak 44 is facing upward.

I contemplate another embodiment, not shown, such as for the sit-on-top kayak comprising two inflatables 20 positioned one on each shoulder of the carrier and releasably fastened to carriage strap 36 which securely encircles kayak 44, whereby carriage strap 36 supports the kayak on inflatables 20. I presently contemplate that the length of inflatable 20 as measure along the length of carriage strap 36 is at least the lateral length of one shoulder of the carrier, however, this is not intended to limit the use of other sizes.

Figure 13:
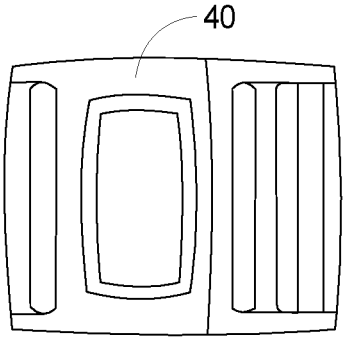
FIG. 13 is top view of a center release buckle.

FIG. 13 is top view of the center release buckle 40.

From the description above, a number of advantages of one or more aspects of the water self-rescuer for single human transport of watercraft such as the kayak become evident:

(a) Distribution of the watercraft weight is substantially equal across both shoulders of the carrier, thus, avoiding asymmetrical weight distribution problems.

(b) Carrying the watercraft in the substantially horizontal position aids the carrier to avoid vertical impediments such as tree branches, and to reduce wind resistance which can be especially problematic on open terrain.

(c) The carrier can simultaneously carry the watercraft and use his/her own backpack to transport food, clothing, and other equipment which eliminates the need for an extra roundtrip across portages, which can save substantial time and energy. For example, a one kilometer portage without the water self-rescuer would require hiking three kilometers in total, thus, the device saves hiking two kilometers.

(d) The water self-rescuer is operable for carrying a variety of watercrafts including kayaks with cockpits, kayaks without cockpits commonly referred to as sit-on-top kayaks, inflatable kayaks, and tandem kayaks for example each carrier uses his/her own water self-rescuer.

(e) The non-rigid material reduces the risk of damaging the watercraft and carrier.

(f) The lighter weight is less onerous to carry.

(g) The smaller size requires less storage space within or on the watercraft.

(h) The inflatable is selectively, continuously, variably inflatable to allow the carrier to elevate the watercraft above his/her shoulders to provide sufficient forward visibility of the terrain to avoid obstacles.

Moreover, two carriers using his/her own water self-rescuer to carry the tandem kayak can individually adjust the angle of the kayak above the horizon to provide greater forward visibility. For example, carriers of the same physical height increases the elevation of the kayak above the shoulders of the carrier in front more than the carrier at the back, thus, angling the kayak upward to provide greater forward visibility.

(i) Operability on generally all terrain which the carrier can walk such as flat, rocky, sandy, muddy, and steep.

(j) Head and neck muscles of the carrier are not required to maneuver the kayak, thus, avoiding potential injury to the head and neck muscles.

While my above description contains many specificities, these should not be construed as limitations on the scope, but rather as an exemplification of one of several embodiments thereof. Many other variations are possible. Accordingly, the scope should be determined not by the embodiments illustrated, but by the appended claims and their legal equivalents.

The invention claimed is:

1. A water self-rescue apparatus, comprising: (a) a one or more than one inflatable; (b) said one or more than one inflatable having a shape; (c) said shape having an open side having an opening and an opposite closed side; (d) said opening having a depth, a width, and a length sized to a human having a one or two lower extremities; (e) said depth of at least a part of said opening, as considered from a top of said opening orthogonally straight down toward said opposite closed side, is about a depth of said one or two lower extremities, as considered from an anterior to posterior of said one or two lower extremities at a greatest distance; (f) said width of at least a part of said opening, as considered traversing said opening, is about a width of said one or two lower extremities, as considered transversely from side to side of said one or two lower extremities at a greatest distance, and above said width of at least a part of said opening is about the width of said one or two lower extremities said width is of lesser distance than the width of said one or two lower extremities; (g) said length of said opening, as considered longitudinally, having a distance of a part of a length of said one or two lower extremities, as considered longitudinally along said one or two lower extremities; and (h) said one or more than one inflatable having a buoyancy to support said one or two lower extremities at or near a surface of a body of water.

2. The apparatus as defined in claim 1, further including a first means for releasably fastening one of said one or more than one inflatable to one of said one or two lower extremities which in combination with one of said one or more than one inflatable surrounds one of said one or two lower extremities to secure one of said one or more than one inflatable to one of said one or two lower extremities.

3. The apparatus as defined in claim 2, further including a second means for releasably fastening two or more than two of said one or more than one inflatable to said one or two lower extremities which in combination with two or more than two of said one or more than one inflatable surrounds said one or two lower extremities to secure two or more than two of said one or more than one inflatable to said one or two lower extremities.

4. The apparatus as defined in claim 1, further including a one or more than one non-rigid, water-resistant strap, comprising: a length to at least extend transversely across one of said one or two lower extremities; and said one or more than one non-rigid, water resistant strap is releasably fastened to one of said one or more than one inflatable.

5. The apparatus as defined in claim 1, further including a one or more than one elastic, water-resistant strap, comprising: a length to at least extend transversely across one of said one or two lower extremities; and an end, of which there are two opposite, with both ends fastened to one of said one or more than one inflatable.

6. The apparatus as defined in claim 1, further including a one or more than one elastic, water-resistant strap, comprising: a length to extend at least transversely across one of said one or two lower-extremities; and an end, of which there are two opposite, with both ends fastened to one of said one or more than one inflatable with at least one end releasably fastened.

7. The apparatus as defined in claim 1, further including an extremity strap having a length to extend at least transversely across one of said one or two lower extremities, and said extremity strap is releasably fastened to two or more than two of said one or more than one inflatable.

8. The apparatus as defined in claim 1, wherein said opening having an incurvate shape.

9. The apparatus as defined in claim 8, further including a first means for releasably fastening one of said one or more than one inflatable to one of said one or two lower extremities which in combination with one of said one or more than one inflatable surrounds one of said one or two lower extremities to secure one of said one or more than one inflatable to one of said one or two lower extremities.

10. The apparatus as defined in claim 8, further including a one or more than one non-rigid, water-resistant strap, comprising: a length to at least extend transversely across one of said one or two lower extremities; and said one or more than one non-rigid, water resistant strap is releasably fastened to one of said one or more than one inflatable.

11. The apparatus as defined in claim 8, further including a one or more than one elastic, water-resistant strap, comprising: a length to at least extend transversely across one of said one or two lower extremities; and an end, of which there are two opposite, with both ends fastened to one of said one or more than one inflatable.

12. The apparatus as defined in claim 8, further including a one or more than one elastic, water-resistant strap, comprising: a length to extend at least transversely across one of said one or two lower-extremities; and an end, of which there are two opposite, with both ends fastened to one of said one or more than one inflatable with at least one end releasably fastened.

13. The apparatus as defined in claim 8, wherein said incurvate shape having a curvature of about 240 to 300 degrees.

14. The apparatus as defined in claim 1, wherein said shape of said one or more than one inflatable is streamlined.

15. The apparatus as defined in claim 14, further including a first means for releasably fastening one of said one or more than one inflatable to one of said one or two lower extremities which in combination with one of said one or more than one inflatable surrounds one of said one or two lower extremities to secure one of said one or more than one inflatable to one of said one or two lower extremities.

16. The apparatus as defined in claim 14, further including a one or more than one non-rigid, water-resistant strap, comprising: a length to at least extend transversely across one of said one or two lower extremities; and said one or more than one non-rigid, water resistant strap is releasably fastened to one of said one or more than one inflatable.

17. The apparatus as defined in claim 14, further including a one or more than one elastic, water-resistant strap, comprising: a length to at least extend transversely across one of said one or two lower extremities; and an end, of which there are two opposite, with both ends fastened to one of said one or more than one inflatable.

18. The apparatus as defined in claim 1, wherein said one or more than one inflatable surrounds and encloses a portion of said one or two lower extremities.

19. A water self-rescue apparatus, comprising: (a) a one or more than one inflatable; (b) said one or more than one inflatable having a shape; (c) said shape having an open side having an opening and an opposite closed side; (d) said opening having a depth, a width, and a length sized to a human having a one or two lower extremities; (e) said depth of at least a part of said opening, as considered from a top of said opening orthogonally straight down toward said opposite closed side, is about a depth of said one or two lower extremities, as considered from an anterior to posterior of said one or two lower extremities at a greatest distance; (f) said width of at least a part of said opening, as considered traversing said opening, is about a width of said one or two lower extremities, as considered transversely from side to side of said one or two lower extremities at a greatest distance, and above said width of at least a part of said opening is about the width of said one or two lower extremities said width is of lesser distance than the width of said one or two lower extremities; (g) said length of said opening, as considered longitudinally, having a distance of a part of a length of said one or two lower extremities, as considered longitudinally along said one or two lower extremities; (h) said opening having an incurvate shape with a curvature of about 240 to 300 degrees; (i) said shape of said one or more than one inflatable is streamlined; and (j) said one or more than one inflatable having a buoyancy to support said one or two lower extremities at or near a surface of a body of water.

20. The apparatus as defined in claim 19, further including a one or more than one non-rigid, water-resistant strap, comprising: a length to at least extend transversely across one of said one or two lower extremities and said one or more than one non-rigid, water resistant strap is releasably fastened to one of said one or more than one inflatable.

* * * * *